US005470056A

United States Patent [19]

Dennesen

[11] Patent Number: 5,470,056

[45] Date of Patent: Nov. 28, 1995

[54] APPARATUS FOR IMPEDING THE MOVEMENT OF A BALL

[76] Inventor: Christopher F. Dennesen, 147 E. Lothrop St., Beverly, Mass. 01915

[21] Appl. No.: 303,079

[22] Filed: Sep. 8, 1994

[51] Int. Cl.[6] ..... A63B 61/00

[52] U.S. Cl. ..... 273/29 B; 273/411

[58] Field of Search ..... 273/29 B, 29 BA, 273/26 R, 29 A, 26 A, 67 R, 73 E, 73 D, 73 G, 411, 389, 398, 400, 401, 402; 273/411, 389, 398, 400, 401, 402

[56] References Cited

U.S. PATENT DOCUMENTS

| | | | |
|---|---|---|---|
| 3,860,240 | 1/1975 | Koch | 273/95 R |
| 4,786,053 | 11/1988 | Barnes, Jr. | 273/26 R |
| 4,948,150 | 8/1990 | Daly, Jr. et al. | 273/411 |
| 4,993,719 | 2/1991 | Hernandez | 273/29 B |
| 5,029,853 | 7/1991 | Cunningham | 273/29 A |
| 5,062,646 | 11/1991 | Crist | 273/411 |

FOREIGN PATENT DOCUMENTS

| | | | |
|---|---|---|---|
| 961716A | 9/1982 | U.S.S.R. | A63B 61/00 |
| WO80/00663 | 4/1980 | WIPO | A63B 63/00 |

*Primary Examiner*—V. Millin
*Assistant Examiner*—Charles W. Anderson
*Attorney, Agent, or Firm*—Testa, Hurwitz & Thibeault

[57] ABSTRACT

A device for use with, and attachment to, a game net to impede the movement of a ball directed at the device includes a frame, an impeding net, and a stabilizing structure. The frame includes a top member and two side members, and one end of each of the two side members is attached to the top of the game net such that a target area at which the moving ball can be directed is defined by the frame and the top of the game net. The impeding net is attached at least to the top member of the frame, spans substantially all of the target area, and extends from the top member to below the top of the game net. The impeding net substantially impedes the movement of the ball when the moving ball passes through the target area. The stabilizing structure stabilizes the frame relative to the game net by extending from the frame to a surface below the game net. The device is easily transported when not attached to the game net because the frame and the stabilizing structure are collapsible.

18 Claims, 2 Drawing Sheets

APPARATUS FOR IMPEDING THE MOVEMENT OF A BALL

FIELD OF THE INVENTION

This invention relates to apparatus for blocking a moving ball, and more particularly, to apparatus which is couplable to a game net.

1. Background of the Invention

Most players of a particular sport practice to improve skills needed to play the sport and to become proficient. Volleyball is a sport in which hitting, spiking, and serving the ball are some of the important aspects of the game. When a player of volleyball practices hitting, spiking, and/or serving the ball, at least one other person typically is present to retrieve the ball after the player hits, spikes, or serves the ball over the volleyball net. The player can practice hitting, spiking, and/or serving the ball alone without the help of another person, but this requires the player to run after the ball which takes away from the time spent training and generally is an undesirable method of practicing.

2. Summary of the Invention

It is an object of the invention to provide a device which allows a person to practice, without the aid of another person, a sport involving the use of a ball and a raised net. With the invention, a player can practice the sport without having to run after the ball to retrieve it after hitting the ball over the net.

It is another object of the invention to provide such a device for use with a volleyball net to allow a volleyball player to hit, spike, and/or serve, for example, the ball over the volleyball net. The device impedes the movement of the hit, spiked, or served ball by effectively blocking it.

Other objects of the invention include providing such a device which can be used indoors or outdoors, which can be collapsed easily for storage and/or transportability, and which can be assembled easily by one person. The player desiring to practice thus can carry and set up the device without help from anyone.

In general, in one aspect, the invention relates to apparatus for use with a raised net to block a moving ball. The apparatus comprises a supporting structure, a blocking device, and a stabilizing structure. The supporting structure is coupled to the net and defines a target space through which the moving ball can be directed. The blocking device is coupled to the supporting structure and spans substantially all of the target space to block the moving ball by substantially impeding the movement of the ball when the moving ball passes through the target space. The stabilizing structure is coupled to the supporting structure to stabilize the supporting structure relative to the net.

Embodiments of this aspect of the invention can include certain features. For example, the supporting structure and the stabilizing structure can be collapsible to make the apparatus easily transportable when the apparatus is decoupled from the net. Also, the net preferably is a volleyball net.

Other objects, aspects, features, and advantages of the invention will become apparent from the following description and from the claims.

BRIEF DESCRIPTION OF THE DRAWINGS

In the drawings, like reference characters generally refer to the same or similar parts throughout the different views. Also, the drawings are not necessarily to scale, emphasis instead generally being placed upon illustrating the principles of the invention.

DESCRIPTION

Figure 1:
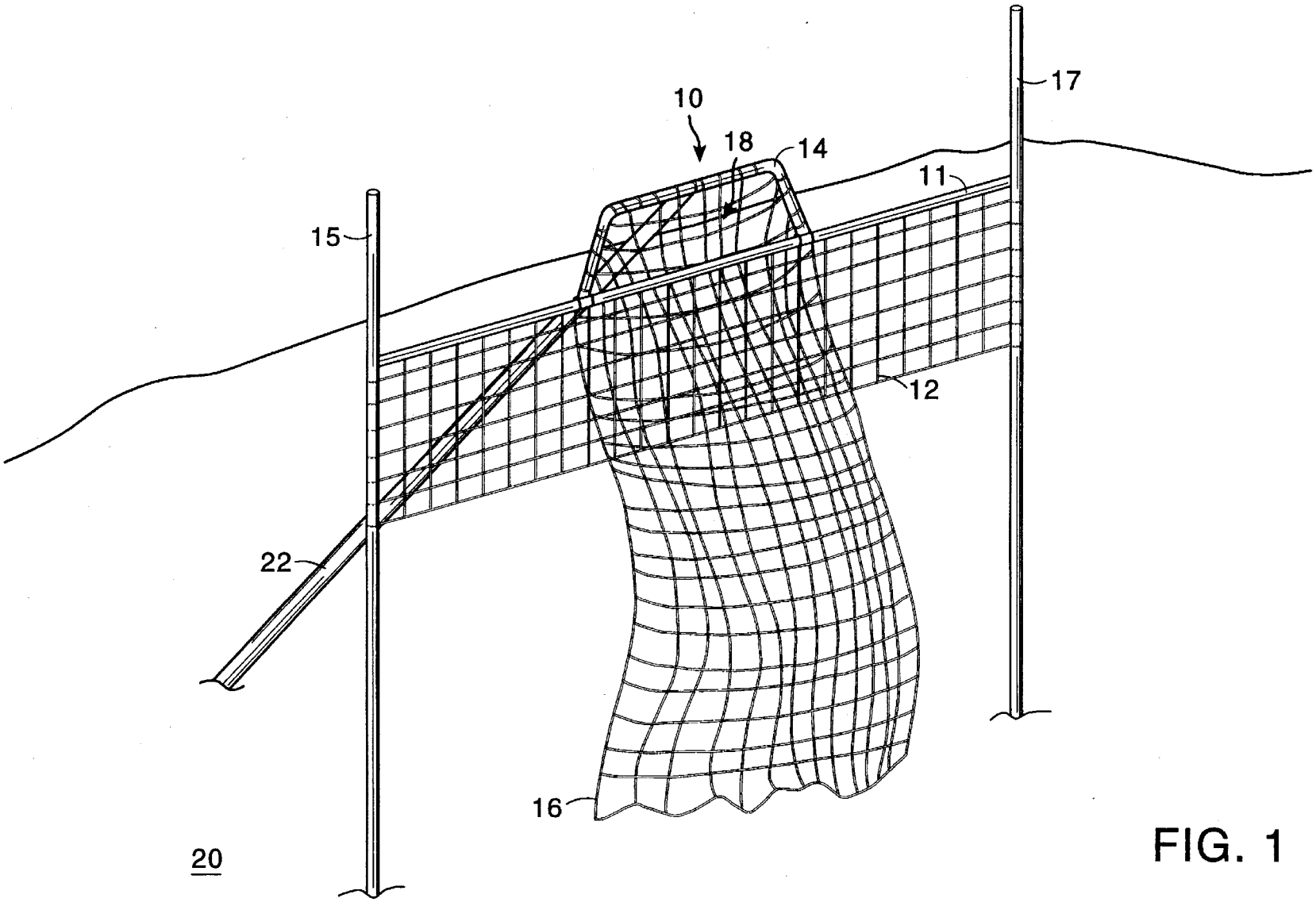
FIG. 1 is a perspective view of apparatus according to the invention as it appears when attached to a net and ready for use.

Referring to FIG. 1, a device 10 according to the invention is shown attached to a top edge 11 of a raised game net 12, such as a volleyball net, which is secured between and raised above a surface 20 by two game posts 15, 17. The device 10 includes a frame 14 which acts as a supporting structure on which mesh netting 16 is attached. The frame 14 is attached to the top edge 11 of the game net 12 such that the frame 14 extends above the top edge 11 of the game net 12. The frame 14 together with the top edge 11 of the game net 12 define a target area 18 through which a ball can be directed. The netting 16 hangs down from the frame 14 to below at least the top edge 11 of the game net 12, and it covers substantially all of the target area 18. The netting 16 provides means for blocking or impeding the movement of a ball which passes through the target area 18. A moving ball which is directed into the target area 18 contacts the netting 16 and is slowed thereby. The force of the moving ball when it contacts the netting 16 causes the netting 16 to move in the direction of movement of the ball, and the netting 16 "catches" the ball. When the ball stops its forward movement into the netting 16, the ball rolls down the netting 16 and either comes to rest on the surface 20 below the device 10 or rolls on the surface 20 back toward the direction from which it came (i.e., back toward a player that directed the ball into the netting 16).

In addition to the frame 14 and the netting 16, the device 10 also includes at least one stabilizer bar or pole 22 which acts as a stabilizing structure to stabilize the frame 14 with respect to the game net 12. In some embodiments of the device 10, two or more stabilizer poles 22 are used. The stabilizer pole(s) 22 lend stabilizing support to the frame 14 such that a ball which hits the frame 14 (e.g., because a player fails to direct accurately the ball into the target area 18) does not knock the frame 14 off of the top edge 11 of the game net 12 or cause the frame 14 to move substantially from its intended operational position above the top edge 11 of the game net 12. The stabilizer pole 22 of FIG. 1 extends from the frame 14 to a point on the surface 20 which is away from the game net 12 and away from the direction in which the ball is moving when it is directed into the target area 18 by the player. The stabilizer pole 22 can have a rubber foot or other means for causing the pole 22 to stay in place on the surface 20 and to provide the proper stabilization to the frame 14. The surface 20 can be, for example, grass, sand, wood, pavement, or any of a variety of other indoor or outdoor surfaces. Note that if the game net 12 is set up beside a wall, the stabilizer pole(s) 22 can extend from the frame 14 to the wall therebeside instead of to the surface 20 therebelow.

The device 10 can be transported, assembled, and used, either indoors or outdoors, by a single person. The frame 14 and the stabilizer pole 22 both can collapse when the device 10 is not attached to the game net 12. This collapsibility feature allows the device 10 to be easily carried and stored in a relatively small space. In some preferred embodiments, the stabilizer pole 22 has two or more segments which when connected together form the stabilizer pole 22. The segments can be connected together by inserting a male end portion of a segment into a female receiving portion of another segment. Other means of connecting the segments can be used as will be realized by those of ordinary skill. To collapse such a segmented stabilizer pole 22, the user decouples the various segments. In some embodiments, the segmented stabilizer pole 22 can have a hinge which couples each segment together such that the pole 22 is collapsed by folding the segments at each hinge. In some other embodiments, the stabilizer pole 22 is telescoping with an adjustable locking mechanism that allows the user to telescope the pole 22 out to the desired length and to telescope it back together to form a compact, collapsed version of the pole 22 suitable for easy transport and storage. Other means of constructing the pole 22 such that it is collapsible also are possible. The frame 14 can be similarly segmented such that it too is collapsible.

Figure 2:
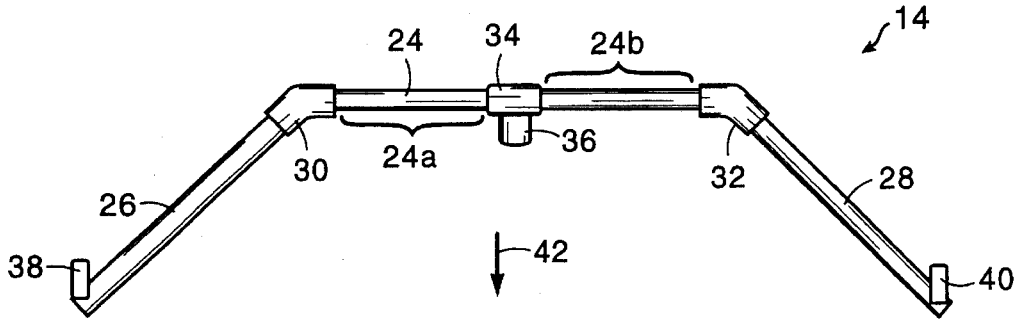
FIG. 2 is a front view of a frame of the apparatus of FIG. 1 looking into a target area formed by the frame in the direction in which a moving ball would be directed into the target area.

Referring to FIG. 2, the frame 14 includes three segments: a top member 24 and two side members 26, 28. These three members couple together at two joints 30, 32, and they together with the top edge 11 of the game net 12 (which is substantially parallel to the top member 24 when the frame 14 is placed on the top edge 11 of the game net 12) form a trapezoid-shaped target area 18. A T-connector 34 surrounds the top member 24 at approximately its middle and provides a receiving pipe 36 within which the stabilizer pole 22 (not shown in FIG. 2) is inserted. At the lower end of each of the two side members 26, 28 is a clip 38, 40 which is secured to the end of the side member and which is designed to fit over the top edge 11 of the game net 12 to secure the frame 14 thereto. The portion of the clips 38, 40 which fits over the top edge 11 of the game net 12 is generally U-shaped with the open part of the "U" facing down. The netting 16 (not shown in FIG. 2) attaches to the frame 14 and hangs down therefrom in the direction of the arrow 42. In some embodiments according to the invention, the netting 16 is tied to the two side members 26, 28 and the portions of the top member 24 identified by the reference numerals **24*a* and 24*b*. The netting 16 can be secured to other areas of the frame 14**, and it can be secured by means other than tying.

The frame 14 preferably is collapsible. In some embodiments, the three members 24, 26, 28 are assembled to form the frame 14 by inserting each member into its respective joint 30, 32. The members can fit tightly into the joints and/or a mechanical locking mechanism can be employed at the joints 30, 32 to keep the members 24, 26, 28 secured to each other via the joints 30, 32. In these embodiments, the frame 14 is collapsed by decoupling the members 24, 26, 28 at the joints 30, 32. Note that the joints 30, 32 can be fixedly attached to one of the members. For example, the joint 30 can be fixed to the side member 26 and the other joint 32 can be fixed to the other side member 28 such that the frame 14 is collapsed by decoupling the top member 24 from the two joints 30, 32. In some other embodiments according to the invention, the joints 30, 32 are hinged such that the frame 14 is collapsed by unlocking the hinges and folding the two side members 26, 28 onto the top member 24. Other means of constructing the frame 14 such that it is collapsible also are possible. If collapsibility is not desired for some reason, the frame 14 can be made of a single piece of material (i.e., no joints 30, 32), or the members 24, 26, 28 can be permanently fixed into the joints 30, 32.

The members 24, 26, 28 of the frame 14 preferably are made of PVC piping having a diameter of 0.75 inches. Other materials can be used for these members. The joints 30, 32 and the T-connector 34 of the frame 14 can be made of a high strength plastic or of a variety of other materials such as metal. The clips 38, 40 preferably are aluminum, but they can be made of a variety of other materials including high strength plastic.

Referring back to FIG. 1, the netting 16 can be a mesh with relatively small openings (e.g., about one inch or less) or it can be a canvas-type material. A variety of other materials also can be used for the netting 16. The material used for the netting 16 should provide means for blocking or impeding the movement of a ball which passes through the target area 18. The netting 16 should be of such a material that a moving ball directed into the target area 18 is slowed when it contacts the netting 16. The netting material should be such that it "catches" the ball by giving way and moving in the direction of the movement of the ball in order to absorb the force of the moving ball when the moving ball contacts the netting material. The netting material also should allow the ball to roll theredown after the ball stops its forward movement thereinto. The netting material should allow the ball to roll theredown and either come to rest on the surface 20 below the device 10 or roll on the surface 20 back toward the player that directed the ball into the device 10.

Figure 3:
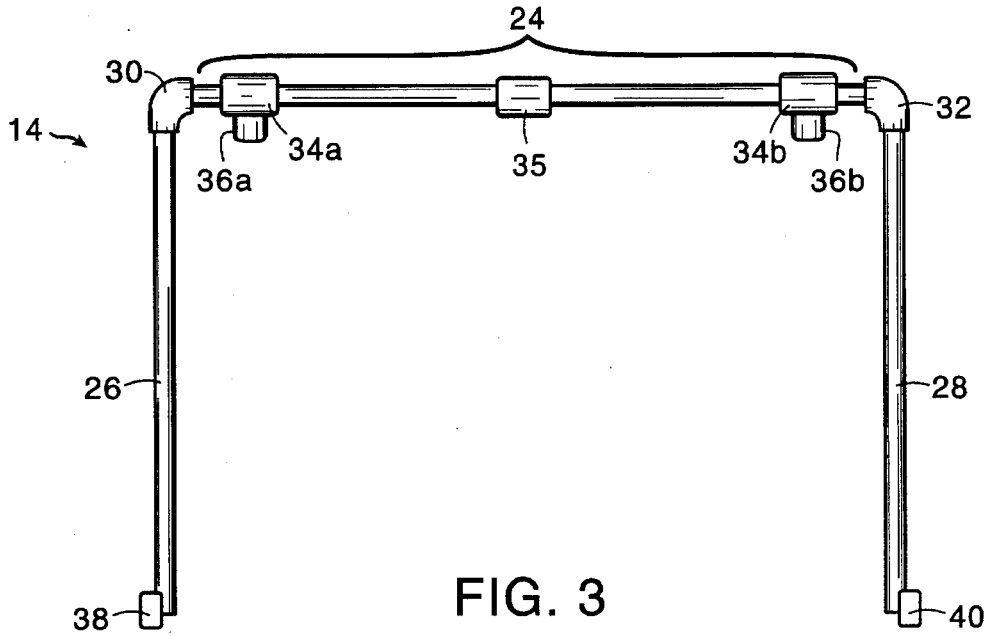
FIG. 3 is a front view of another embodiment of the frame of the apparatus of FIG. 1.

Referring now to FIG. 3, another embodiment of the frame 14 also includes three segments (i.e., the top member 24 and the two side members 26, 28), but the three members are arranged such that they together with the top edge 11 of the game net 12 form a square or rectangular target area 18. For a square target area, all three members 24, 26, 28 have approximately the same length, and for a rectangular target area, the two side members 26, 28 have approximately the same length and are either greater than or less than the length of the top member 24. Whether the target area 18 is square-shaped or rectangular-shaped, the two side members 26, 28 are substantially parallel to each other and the top member 24 and the top edge 11 of the game net 12 also are substantially parallel to each other. Like the trapezoidal embodiment of the frame 14 described previously and shown in FIGS. 1 and 2, the square or rectangular embodiment of the frame 14 shown in FIG. 3 includes joints 30, 32 which couple the three members 24, 26, 28 together. The frame 14 of FIG. 3 also includes a joint 35 located approximately in the middle of the top member 24 because the top member 24 is itself actually formed of two segments. Two T-connectors **34*a*, 34*b* surround the top member 24 at each end and provide receiving pipes 36*a*, 36*b* within which two stabilizer poles 22 (not shown in FIG. 3) are inserted. At the lower end of each of the two side members 26, 28 is the U-shaped clip 38, 40. The frame 14 of FIG. 3 can be collapsible in any of the ways described previously with reference to FIGS. 1 and 2. The materials from which the frame 14 of FIG. 3 can be made were described previously with reference to FIGS. 1 and 2**.

Figure 4:
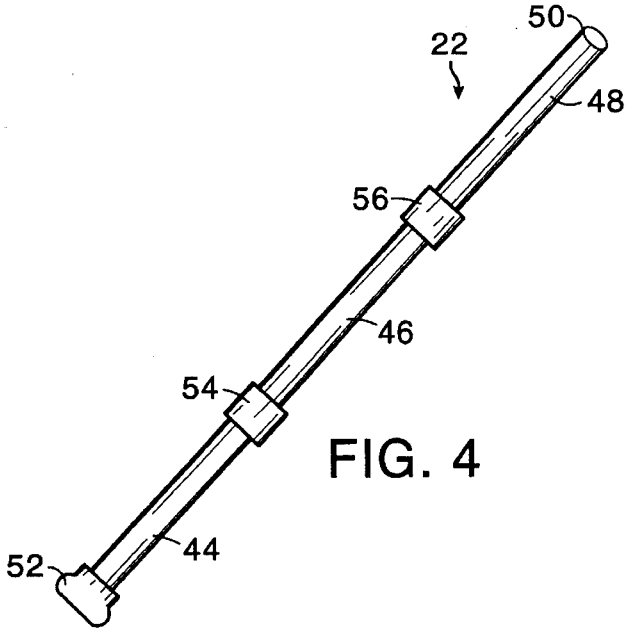
FIG. 4 is a view of a stabilizer pole of the apparatus of FIG. 1.

Referring to FIG. 4, a stabilizer pole 22 for insertion into the T-connector(s) 34 of the frame 14 is approximately twelve feet in length. The length of the pole 22 can be other than twelve feet depending on the particular application. The stabilizer pole 22 preferably is formed of three segments 44, 46, 48, but it can also include a different number of segments (e.g., two segments or more than three segments) or be a single piece. The pole 22 has one end 50 designed for insertion into a T-connector 34 of the frame 14. At the other end of the pole 22 preferably is a rubber foot 52 or other means for causing the pole 22 to stay in place on the surface 20 (FIG. 1) and to provide the proper stabilization to the frame 14. If the game net 12 is set up beside a wall, the stabilizer pole 22 can extend from the frame 14 to the wall therebeside instead of to the surface 20 therebelow. In either configuration, the stabilizer pole 22 stabilizes the frame 14 relative to the game net 12.

The stabilizer pole 22 preferably is collapsible. In some embodiments, the segments 44, 46, 48 are assembled to form the pole 22 by inserting each segment into its respective joint 54, 56. The segments can fit tightly into the joints and/or a mechanical locking mechanism can be employed at the joints 54, 56 to keep the segments 44, 46, 48 secured to each other via the joints 54, 56. In these embodiments, the frame 14 is collapsed by decoupling the segments 44, 46, 48 at the joints 54, 56. Note that the joints 54, 56 can be fixedly attached to one of the segments. For example, the joint 54 can be fixed to the segment 44 and the other joint 56 can be fixed to another segment 46 such that the pole 22 is collapsed by decoupling the middle segment 46 from the lower joint 54 and decoupling the upper segment 48 from the upper joint 56. In some other embodiments according to the invention, the joints 54, 56 are hinged such that the pole 22 is collapsed by unlocking the hinges and folding the upper and lower segments 48, 44 onto the middle segment 46. In still other embodiments, the segments 44, 46, 48 are coupled by screwing them together at the joints 54, 56 which are screw-threaded. In yet still other embodiments, the stabilizer pole 22 is telescoping and can include a locking mechanism that allows the user to telescope the pole 22 out to the desired length and to telescope it back together to form a compact, collapsed version of the pole 22 suitable for easy transport and storage. Other means of constructing the pole 22 such that it is collapsible also are possible. If collapsibility is not desired for some reason, the pole 22 can be made of a single piece of material (i.e., no joints 54, 56), or the segments 44, 46, 48 can be permanently fixed into the joints 54, 56.

The segments 44, 46, 48 of the stabilizer pole 22 can be made of PVC piping having a diameter of 0.75 inches or of a variety of other materials such as metal. The joints 54, 56 also can be made of plastic or metal.

Other modifications and implementations will occur to those of ordinary skill in the art without departing from the spirit and the scope of the invention as claimed. Accordingly, the invention is to be defined not by the preceding illustrative description but instead by the following claims.

What is claimed is:

1. Apparatus in combination with a raised volleyball net to block a moving ball, comprising:

a supporting structure coupled to, and disposed substantially above, the top of the volleyball net such that a target space is defined by the supporting structure and the top of the volleyball net;

a blocking device coupled to the supporting structure and spanning substantially all of the target space for blocking the moving ball by substantially impeding the movement of the ball when the moving ball passes through the target space, the blocking device having at least a portion thereof free of the supporting structure such that a portion of the blocking device hangs down freely from the supporting structure and overlaps with at least a portion of the volleyball net; and a stabilizing structure coupled to the supporting structure for stabilizing the supporting structure in relation to the volleyball net.

2. The apparatus of claim 1 wherein:

the supporting structure comprises a top member and two side members, each of the two side members including a first end coupled to the top member and a second end attached to the top of the volleyball net; and the target space is bounded by the top member, the two side members, and the top of the volleyball net.

3. The apparatus of claim 2 wherein:

the top member and the top of the volleyball net are substantially parallel to each other; and the two side members are substantially parallel to each other and are of substantially equal length so as to define the target space as a square or rectangle.

4. The apparatus of claim 2 wherein:

the top member and the top of the volleyball net are substantially parallel to each other; and the two side members are angled with respect to each other so as to define the target space as a trapezoid.

5. The apparatus of claim 2 wherein the supporting structure is collapsible, when detached from the top of the volleyball net, by decoupling each of the two side members from the top member.

6. The apparatus of claim 2 wherein:

the first end of each of the two side members is coupled to the top member by a hinge; and the supporting structure is collapsible, when detached from the top of the volleyball net, by folding each of the two side members at the hinge.

7. The apparatus of claim 1 wherein the blocking device comprises a mesh netting, some of which hangs down freely from the supporting structure to below the top of the volleyball net.

8. The apparatus of claim 1 wherein the stabilizing structure comprises at least one pole extending from the supporting structure to a surface below or beside the volleyball net.

9. The apparatus of claim 8 wherein the pole is telescoping.

10. The apparatus of claim 8 wherein the pole is collapsible.

11. The apparatus of claim 10 wherein the pole includes at least two segments which are coupled together and which are decouplable to collapse the pole.

12. The apparatus of claim 11 wherein the segments are coupled together by a hinge which allow the pole to be collapsed by folding at the hinge.

13. A system for impeding the movement of a ball, comprising:

a raised volleyball net;

a frame coupled to the volleyball net and extending above the top of the volleyball net, the frame and the top of the volleyball net together defining a target space;

impeding means coupled to the frame and spanning substantially all of the target space for substantially impeding the movement of the ball when the moving ball passes through the target space, the impeding means having at least a portion thereof free of the frame such that a portion of the impeding means hangs down freely from the frame and overlaps with at least a portion of the volleyball net; and stabilizing means coupled to the frame for stabilizing the frame relative to the volleyball net.

14. The system of claim 13 wherein the stabilizing means comprises at least one pole extending from the frame to a surface below or beside the volleyball net.

15. The system of claim 14 wherein the frame and the pole are both collapsible.

16. The system of claim 13 wherein the impeding means comprises a mesh netting, some of which hangs down freely from the frame to below the top of the volleyball net.

17. A collapsible device for impeding the movement of a ball directed at the device, comprising:

a raised volleyball net;

a frame disposed above the volleyball net, the frame including a top member and two side members, each of the two side members having an end furthest from the top member which is attached to the top of the volleyball net, the frame and the top of the volleyball net together defining a target area at which the moving ball is directable;

an impeding net attached at least to the top member of the frame and spanning substantially all of the target area for substantially impeding the movement of the ball when the moving ball passes through the target area, the impeding net having at least a portion thereof free of the frame such that a portion of the impeding net hangs down freely from the frame and overlaps with at least a portion of the volleyball net; and a stabilizer which extends from the frame to a surface below or beside the volleyball net to stabilize the frame relative to the volleyball net;

wherein the frame and the stabilizer are collapsible when the device is not attached to the volleyball net thereby making the device transportable.

18. The device of claim 17 wherein the stabilizer comprises at least one pole attached to the frame.

* * * * *